United States Patent [19]

Hashizume

[11] Patent Number: 4,522,186

[45] Date of Patent: Jun. 11, 1985

[54] IGNITION CIRCUIT FOR AN INTERNAL COMBUSTION ENGINE

[75] Inventor: Atsushi Hashizume, Himeji, Japan

[73] Assignee: Mitsubishi Denki Kabushiki Kaisha, Tokyo, Japan

[21] Appl. No.: 560,269

[22] Filed: Dec. 12, 1983

[30] Foreign Application Priority Data

Dec. 16, 1982 [JP] Japan ..... 57-222524

[51] Int. Cl.[3] ..... F02P 3/04

[52] U.S. Cl. ..... 123/643; 123/622

[58] Field of Search ..... 123/621, 622, 643, 416, 123/417

[56] References Cited

U.S. PATENT DOCUMENTS

| | | | |
|---|---|---|---|
| 4,085,714 | 4/1978 | Hattori et al. | 123/117 |
| 4,100,895 | 7/1978 | Hattori et al. | 123/117 |
| 4,378,004 | 3/1983 | Petrie | 123/643 |
| 4,457,286 | 7/1984 | Katayama et al. | 123/643 X |

FOREIGN PATENT DOCUMENTS

| | | | |
|---|---|---|---|
| 22034 | 2/1979 | Japan | 123/643 |
| 37536 | 3/1980 | Japan | 123/621 |

*Primary Examiner*—Tony M. Argenbright

*Attorney, Agent, or Firm*—Wenderoth, Lind & Ponack

[57] ABSTRACT

An ignition circuit for an internal combustion engine has a flip-flop circuit (8), operated by narrow width output pulses (c, d) of an ignition timing computing circuit (4), thereby to distribute output pulses of a duty cycle control circuit (5) to ignition coils; thus a large advance of ignition pulses is obtainable.

5 Claims, 7 Drawing Figures

IGNITION CIRCUIT FOR AN INTERNAL COMBUSTION ENGINE

BACKGROUND OF THE INVENTION

1. Field of the Invention

The present invention relates generally to an improvement in an ignition circuit for an internal combustion engine, and more particularly to an ignition circuit for an internal combustion engine wherein ignition timing and ignition duty cycle are controlled by electronic circuitry.

2. Description of the Prior Art

Among ignition circuits for internal combustion engines, wherein ignition timing and ignition duty cycle periods are controlled by electronic circuitry, prior art such as that disclosed in the Japanese unexamined published patent application Sho 56-50263 is directed toward two-cylinder engines. Operation of such prior art is described with reference to the graph of FIG. 1, which illustrates intermediate signals for producing ignition signals in accordance with prior art circuitry. These ignition signals are produced by utilizing piston phase detection signals A and B developed by first phase detection sensors (not shown) and second phase detection sensors (not shown) for first and second pistons, respectively. A logic output C is produced by summing the first piston phase detection signal A and the second piston phase detection signal B. By utilizing outputs of an ignition timing computing circuit and an ignition duty cycle computing circuit, desired ignition timing signal D and duty cycle signal E, which are suitably selected for modes of engine operation, are obtainable. Signals D and E are now logically combined to produce a signal F which in turn is combined with a signal G of an output terminal Q of a flip-flop and with a signal H of an output terminal $\overline{Q}$ of the flip-flop to produce ignition coil signals I and J for first and second engine cylinders, respectively. The resultant signals I and J are used to control electronic switching devices, such as power transistors, which are connected in series with first and second ignition coils to the first and second cylinders, respectively. Primary current waveforms of the first and second ignition coils are as shown in the waveforms K and L, respectively.

In the above-mentioned prior art apparatus, wherein for instance, the internal combustion engine has two cylinders, the start times of currents to the ignition coils are at $\theta_d$, and the termination times of the currents are at $\theta_f$. As the speed of revolution of the internal combustion engine increases, the current start and termination times advance, controlled by the ignition timing computing circuit and the ignition duty cycle control circuit. At maximum advance, the start times $\theta_d$ reach the times $\theta_1$, and the termination times $\theta_f$ coincide with times $\theta_2$, as shown in FIG. 1.

In such apparatus, the start times $\theta_d$ cannot advance beyond $\theta_1$ which is on the leading edge of a pulse of signal H, since the times $\theta_d$ are determined by logically processing the signals F and H. In the above-mentioned conventional two cylinder engine ignition apparatus, the maximum advance of the ignition phase is only $180°-(\theta_2-\theta_3)$, wherein $\theta_2$ and $\theta_3$ are respectively phases of the front and rear edges of the phase detection signals A and B and $(\theta_2-\theta_3)$ is the required timing advance. In case of a three cylinder engine, the maximum advance of the ignition phase is only $120°-(\theta_2-\theta_3)$. In an example wherein $(\theta_2-\theta_3)$ is 30°, the maximum allowable advance of the start time of the ignition pulses for a two cylinder engine is only 150°, and this corresponds to about 3.1 m sec for an 8000 rpm engine speed. For a three cylinder engine, the maximum allowable advance of the current start times is only 90°, corresponding to about 1.9 m sec for an 8000 rpm engine speed. Therefore, depending on the characteristic of the ignition coil to be used, there is a problem that the duty cycle of the ignition signal may be insufficient. In very high speed revolution of the engine, because of insufficient advance of the start times, the duty cycle of the ignition current pulses fed to the ignition coils becomes too small and accordingly, sufficient spark energy cannot be obtained in the conventional apparatus.

Furthermore, when a vacuum phase advance device or the like is added, the advance becomes even greater than 30°, and accordingly the above-mentioned defect becomes even more prominent.

SUMMARY OF THE INVENTION

Accordingly, the primary purpose of the present invention is to provide an improved ignition apparatus for an internal combustion engine, wherein the above-mentioned shortcoming is eliminated.

According to the present invention, a sufficient advance of ignition timing is achievable, and accordingly sufficiently large duty cycle ignition pulses to be fed to the ignition coils are obtainable, thereby assuring sufficient spark energy even for very high speeds of revolution of an internal combustion engine.

The ignition circuit for the internal combustion engine in accordance with the present invention comprises:

at least two phase detection devices for at least two cylinders, each for producing a phase signal by detecting the phase of relative movements of corresponding pistons of the cylinders, a first gate means for producing time sequential pulse signals by superimposing the phase signals, an ignition timing computing circuit for producing a signal defining ignition timing corresponding to engine operating parameters, a duty cycle control circuit for producing a signal for controlling the duty cycle of pulses of primary ignition current, a flip-flop having an output that is alternately set and reset in response to pulses developed by the timing computing circuit, at least two other gates responsive to the duty cycle control circuit for distributing pulses to at least two cylinders, said pulses being synchronized to the ouput of said flip-flop, and at least two switching devices controlled by the ignition pulses of corresponding ones of the at least two other gates, for switching primary currents to be applied to ignition coils.

Still other objects and advantages of the present invention will become readily apparent to those skilled in this art from the following detailed description, wherein I have shown and described only the preferred embodiments of the invention, simply by way of illustration of the best mode contemplated by me of carryng out my invention. As will be realized, the invention is capable of other and different embodiments, and its several details are capable of modification in various, obvious respects, all without departing from the invention. Accordingly, the drawings and description are to be regarded as illustrative in nature, and not as restrictive.

DESCRIPTION OF THE PREFERRED EMBODIMENTS

Hereafter, the present invention is described in detail with reference to FIG. 2 and thereafter.

Figure 2:
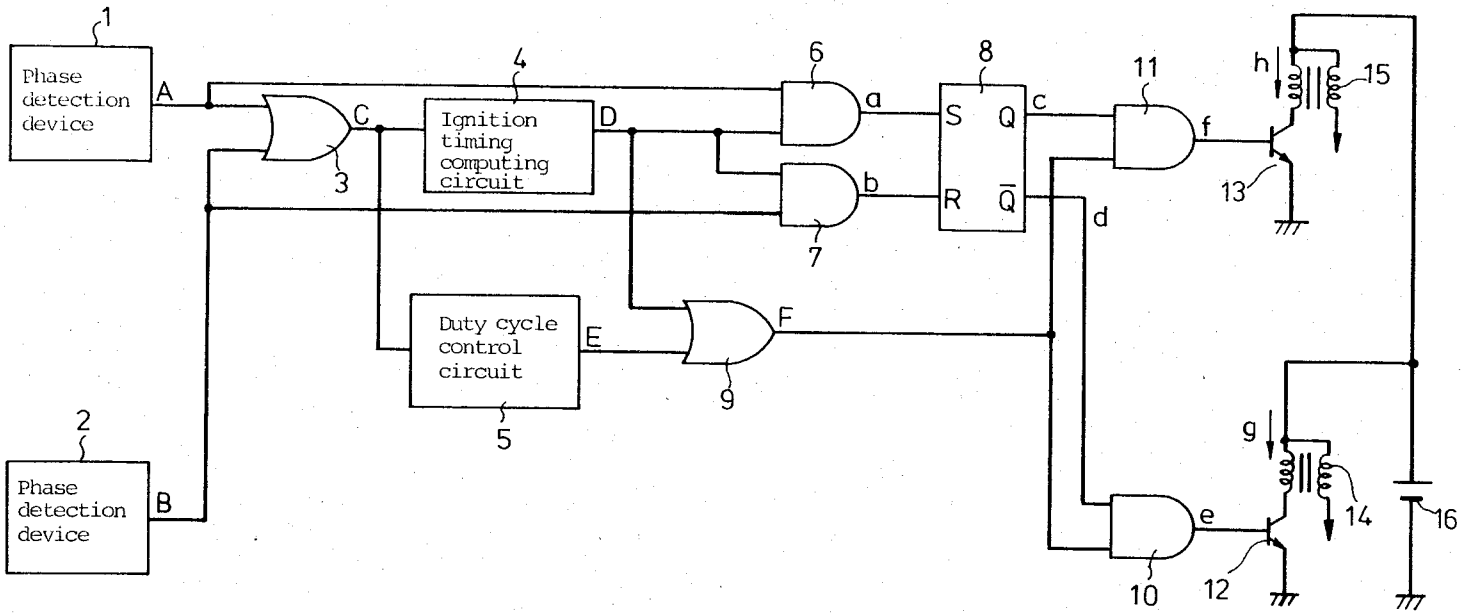
FIG. 2 is a circuit block diagram of a first embodiment of the present invention.

In a first embodiment of an ignition circuit for an internal combustion engine, shown in FIG. 2, a first phase detector 1 and a second phase detector 2 for detection of the phases of relative piston motion in first and second cylinders, are connected to apply output signals to a first gate circuit 3 which is an OR gate. The phase detection devices 1 and 2 are provided on the internal combustion engine (not shown in the drawing) and the gate circuit 3 develops a pulse signal in which outputs of the first and the second phase detectors 1 and 2 are combined in time sequence.

A known ignition timing computing circuit 4 and a known duty cycle control circuit 5 are connected to the output terminal of the gate circuit 3. As the ignition timing computing circuit 4 and the duty cycle control circuit 5, the known art disclosed by the U.S. Pat. Nos. 4,085,714 and 4,100,895 both for Tadashi Hattori et al. may be used. The ignition timing computing circuit 4 computes the necessary phase advance characteristics required by the engine for instantaneous speeds of rotation of the engine and others. The duty cycle control circuit 5 controls the duty cycle of the ignition signal to be fed to ignition coils 14 and 15, so as to produce an appropriate ignition spark energy required for various engine operating speeds. The circuits 4, 5 are controlled by the input signal from the first gate 3.

A second gate 6, which is an AND gate, and a third gate 7, which is also an AND gate, each have one input terminal connected to the output terminal of the ignition timing computing circuit 4. The other input terminal of the second gate 6 is connected to the first angular phase detection device 1, and the other input terminal of the third gate 7 is connected to the second angular phase detection device 2.

The second gate 6 and the third gate 7 distribute the output signals of the ignition timing computing circuit 4 to the input terminal S and the other input terminal R of an S-R flip-flop 8 depending on the timing of the output signals of the phase detection devices 1 and 2, respectively. That is, the S-R flip-flop 8 is set by a trailing edge of the output pulse of the second gate 6 and reset by a trailing edge of the output pulse of the third gate.

A fourth gate 9, an OR gate, has one input terminal connected to the output terminal of the ignition-timing computing circuit 4 and its other input terminal connected to the output terminal of the duty cycle control circuit 5. Gate 9 combines output signals of the ignition timing computing circuit 4 and the duty cycle control circuit 5.

A fifth gate 10 and a sixth gate 11 are connected by their first input terminals to the $\overline{Q}$ and Q output terminals of the S-R flip-flop 8, respectively. The second input terminals of the gate 10, 11 are connected commonly to the output terminal of the fourth gate 9. Therefore, the fifth gate 10 produces a logic product signal of the output signals of the $\overline{Q}$ output terminal and the fourth gate 9. Similarly the sixth gate 11 develops a logic product signal of the Q output terminal and the output of the fourth gate 9.

A first switching device 12 has its base connected to the output terminal of the fifth gate 10, its emitter connected to the ground and its collector connected to a primary coil of a first ignition coil 14 which is connected to a battery 16. A second switching device 13 has its base connected to the output terminal of the sixth gate 11, its emitter connected to the ground and its collector connected to a primary coil of a second ignition coil 15 which is also connected to the battery 16.

Figure 3:
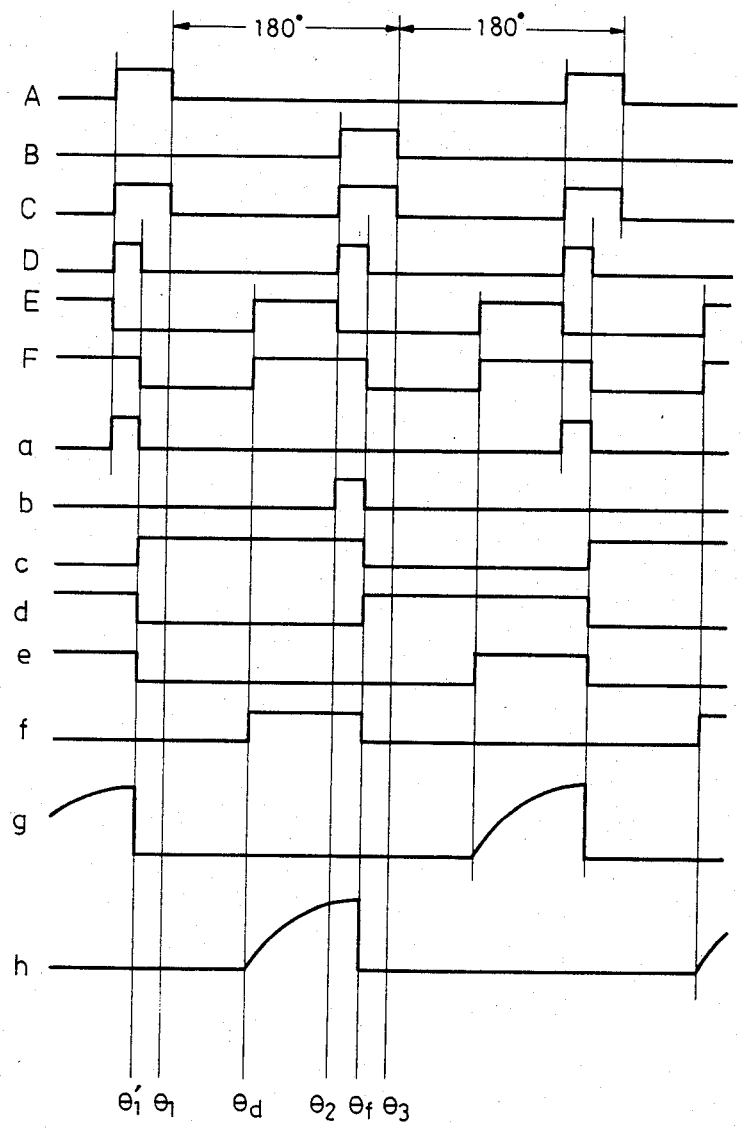
FIG. 3 is a graph showing electrical signals for producing ignition pulse signals in accordance with the apparatus of FIG. 2.

The operation of the above-mentioned circuit of the first embodiment is described hereafter with reference to the graph of FIG. 3. Waveforms designated as A, B, C, D, E, F, a, b, c, . . . and h in FIG. 3 are related to corresponding ones of outputs A, B . . . E, F, a, b, c, d, e, f, g and h in FIG. 2. Output signals A and B developed from the phase detection devices 1 and 2 are combined into one signal by the gate 3, to produce a composite signal C. The ignition timing computing circuit 4 and the duty cycle control circuit 5 develop output signals D and E in synchronism with output signal C of the gate 3 containing the information of the two phase detection devices A and B, respectively. The output signals D and E are combined by the fourth gate 9 into one signal F which has information signals corresponding to the first and second cylinders. Since the second gate 6 issues a "1" signal only when output signal A of the first phase detection device 1 is a "1" and simultaneously the output signal D of the ignition timing computing circuit 4 is a "1", the second gate 6 develops an output signal a. The third gate 7 also develops an output signal "1" only when the output signal B of the second phase detection device 2 is a "1" and simultaneously the output signal D of the ignition timing computing circuit 4 is a "1", to produce an output signal b. The S-R flip-flop 8 is set at the timing of the trailing edge of output signal a of the second gate changing from "1" to "0", and its Q output signal c changing from "0" to "1"; the other output signal d of the output terminal $\overline{Q}$ simultaneously changes from "1" to "0". By receiving another output signal a and receiving another output signal b, the above-mentioned operation repeats.

The fifth gate 10 develops an output signal "1" only when the $\overline{Q}$ output signal d and the output signal F of the fourth gate 9 are both "1", to produce the output signal e which includes only the first cylinder information. The sixth gate 11 develops an output signal "1" only when the Q output signal c and the output signal F of the fourth gate 9 are both "1", to produce the output signal f which includes only the second cylinder information.

The first switching device 12, such as a power transistor, switches current flowing through the primary coil of the ignition coil 14 based on the base input signal e. The second switching device 13 switches the current of the primary coil of the second ignition coil 15 based on the base input signal f. As the speed of revolution of the engine becomes higher than that shown in FIG. 3, the position of the ouput signal E of the duty cycle control circuit 5 advances, i.e., moves leftward in FIG. 3. The timing of the ignition starting $\theta_d$ can shift just behind the limit of the timing position of $\theta_1'$ which is the timing position of the other cylinder, in its most advanced state. Therefore, the apparatus can provide sufficient ignition energy to the ignition coil even at a very high speed of rotation, without insufficiency of the duty cycle of the ignition coil current.

Figure 4:
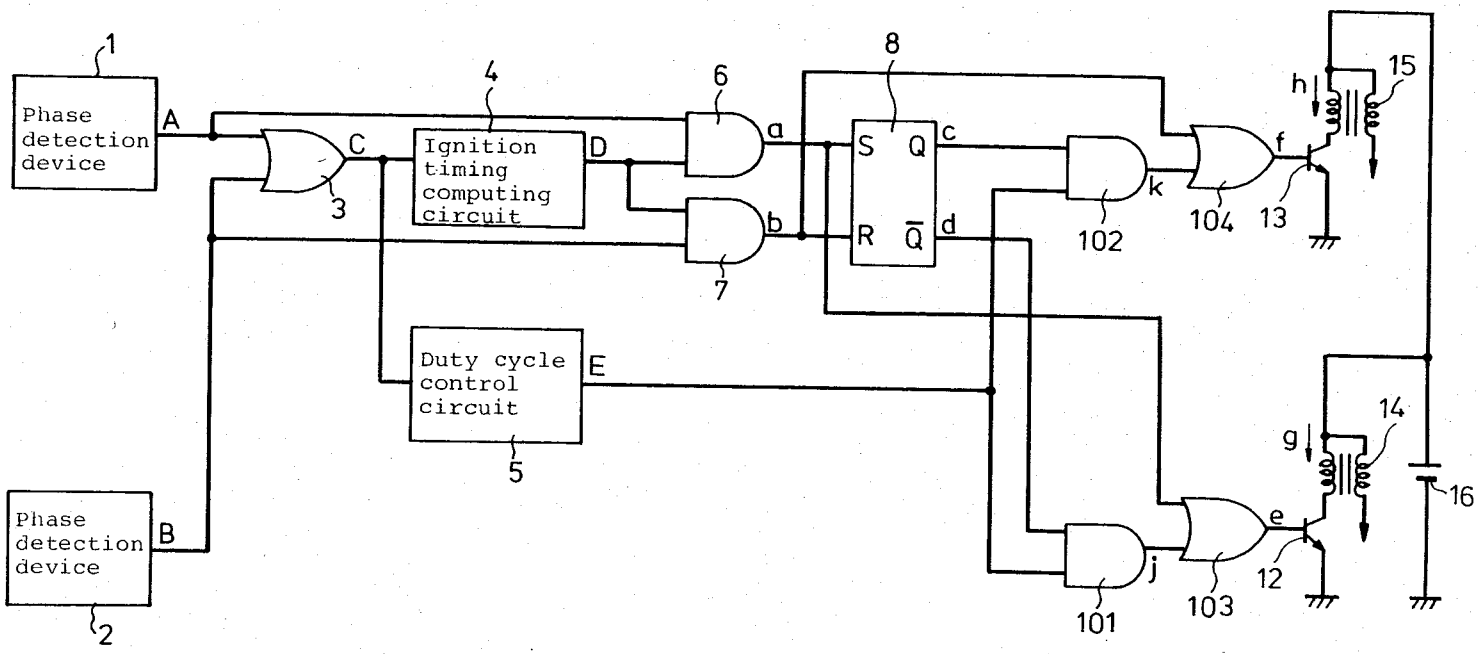
FIG. 4 is a circuit block diagram of a second embodiment of the present invention.
Figure 5:
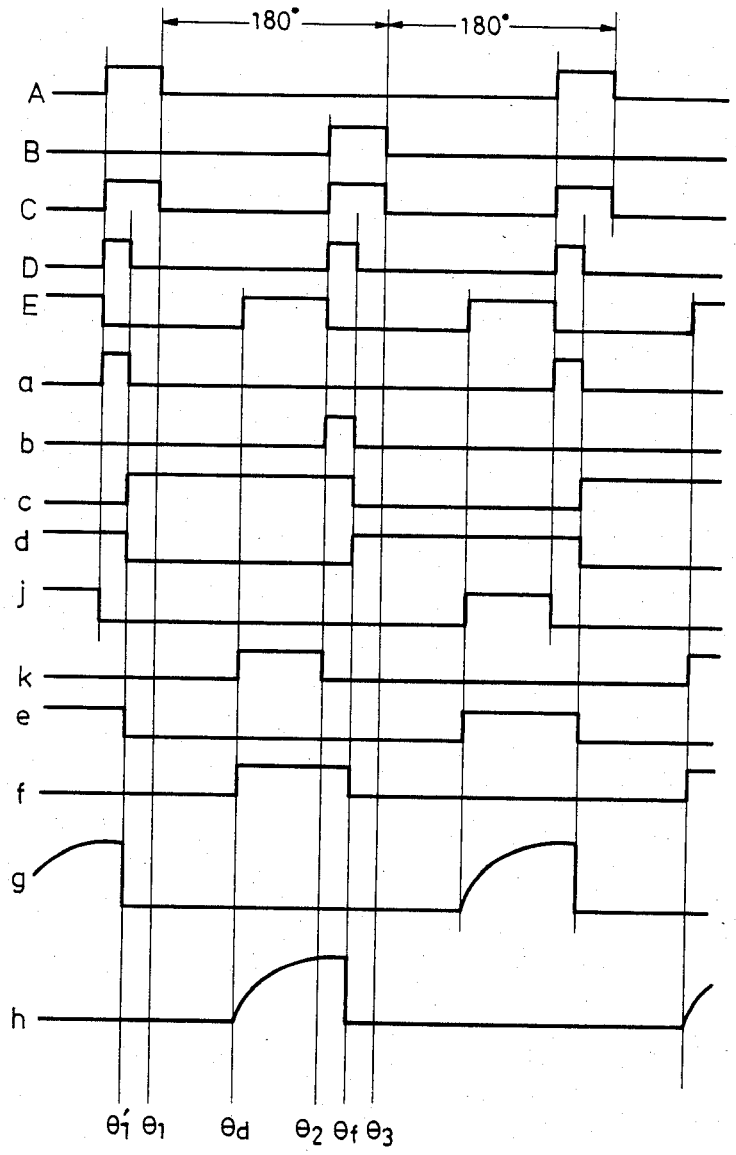
FIG. 5 is a graph showing electrical signals for producing ignition pulse signals in accordance with the apparatus of FIG. 4.

FIG. 4 is a circuit block diagram showing a circuit configuration of a second embodiment of an ignition circuit for an internal combustion engine, and FIG. 5 is a graph showing intermediate signals for producing an ignition signal in accordance with the circuit of FIG. 4. Parts and eomponents as well as signals of this example similar to those of the first example shown in FIG. 2 are not shown or described hereinafter for brevity.

Referring to FIGS. 4 and 5, the circuit configuration of the second embodiment comprises a pair of gates 101 and 102, which are AND gates, and another pair of gates 103 and 104, which are OR gates. The AND gates 101 and 102 have first input terminals connected to the $\overline{Q}$ and Q output terminals of the S-R flip-flop 8, respectively, and have second input terminals commonly connected to the output terminal of the duty cycle control circuit 5 to receive output signal E. The OR gates 103 and 104 have first input terminals connected to the output terminals of the second gate 6 and the third gate 7, to receive the output signals a and b, respectively, and have second input terminals connected to the output terminals of the AND gates 101 and 102, to receive output signals j and k respectively. The output terminals of the OR gates 103 and 104 are connected to the bases of the first transistor 12 and the second transistor 13, respectively.

AND gate 101 develops a logic product output signal j, which is a product of the output signal d of the $\overline{Q}$ output terminal of the S-R flip-flop 8 and the output E of the duty cycle control circuit 5. The AND gate 102 develops a logic product output signal k, which is a product of the output signal c of the Q output terminal of the S-R flip-flop 8 and the output E of the duty cycle control circuit 5, as shown in FIG. 5. The OR gate 103 develops a logic sum output signal 3 of the output signal a of the second gate 6 and the output signal j of the AND gate 101. OR gate 104 develops a logic sum output signal f of the outout signal b of the third gate 7 and the output k of the AND gate 102, as shown in FIG. 5. Accordingly, the output signal E of the duty cycle control circuit 5 is distributed by the gates 101 and 102, utilizing the output signals c and d of the S-R flip-flop circuit 8, to the OR gates 103 and 104 for producing ignition signals for the first and the second cylinders, respectively. In the OR gates 103 and 104, the signals a and b are added to the signals j and k, to produce the composite signals e and f for the first and the second switching transistors 12 and 13, respectively.

Figure 1:
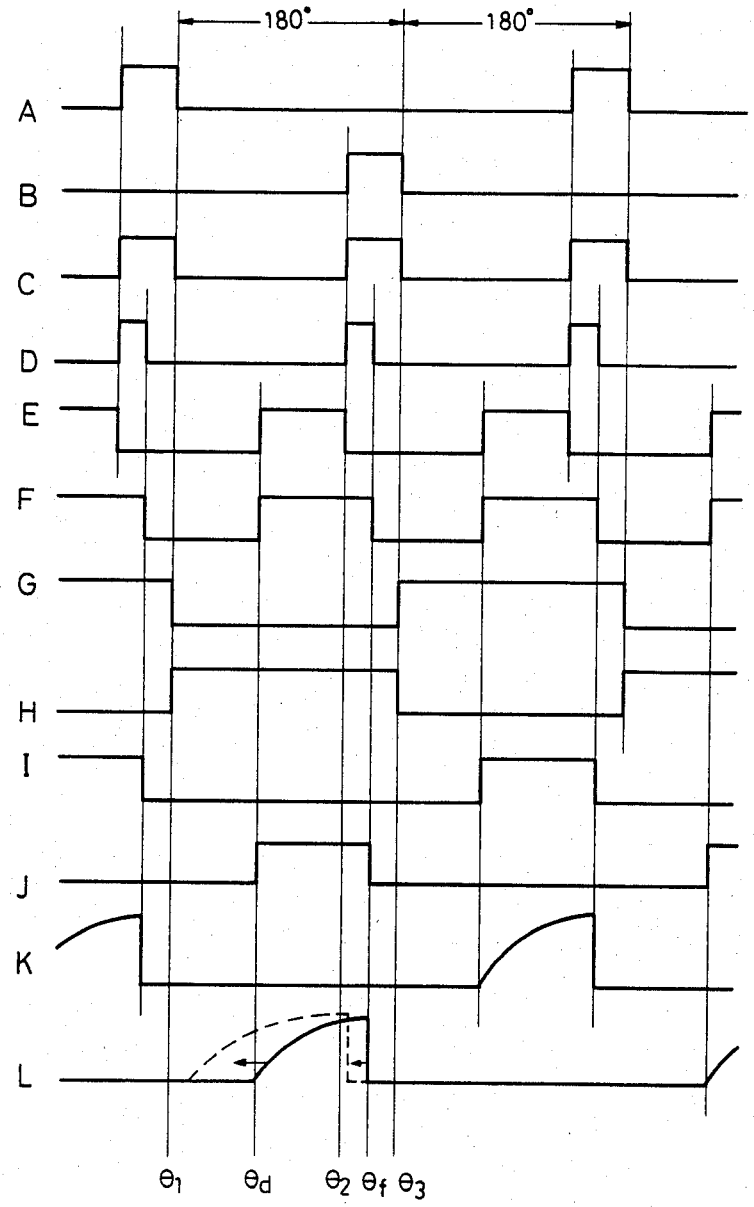
FIG.1 (Prior Art)
FIG. 1 is a graph showing electrical signals for producing ignition pulse signals in accordance with the prior art.

As in the first embodiment of FIG. 1, in the circuit of the second embodiment of FIG. 4, the timing of the start of ignition $\theta_d$ can shift just behind the limit of the timing position $\theta_1'$ which is the timing position of the other cylinder in its most advanced state. Therefore, this embodiment also can provide sufficient ignition energy to the ignition coil even at a very high speed of rotation, without insufficiency of the duty cycle of the ignition coil current.

Figure 6:
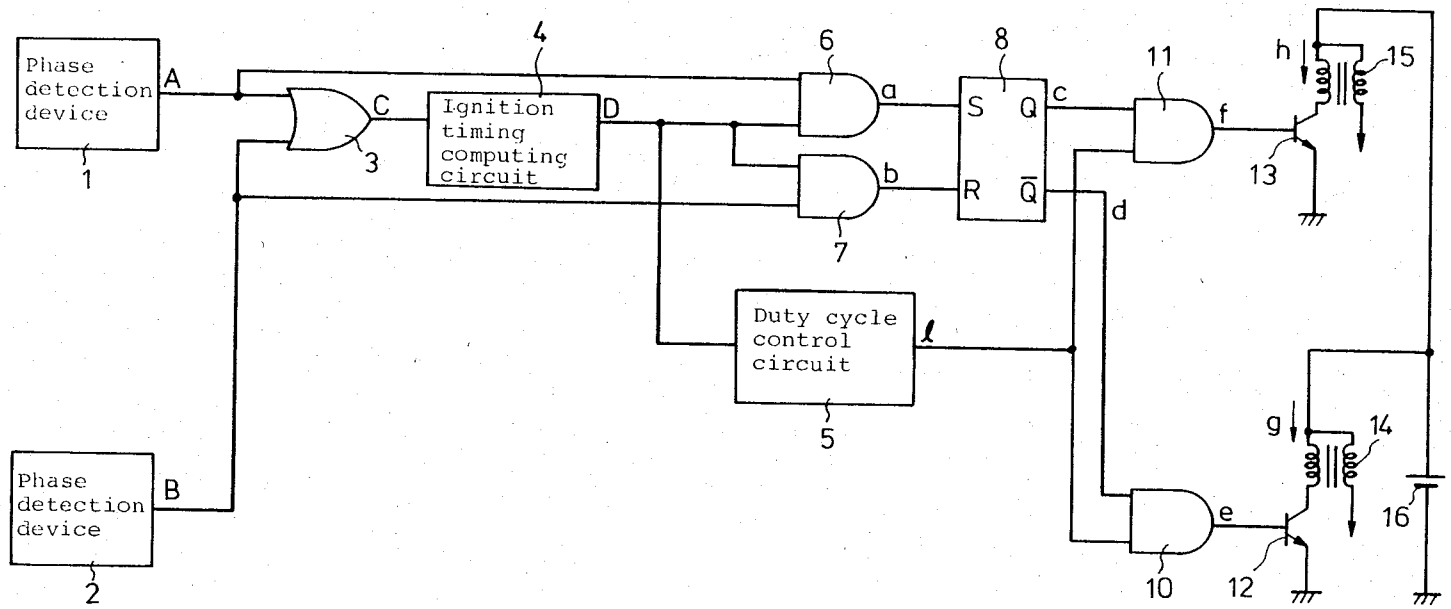
FIG. 6 is a circuit block diagram of a third embodiment of the present invention.
Figure 7:
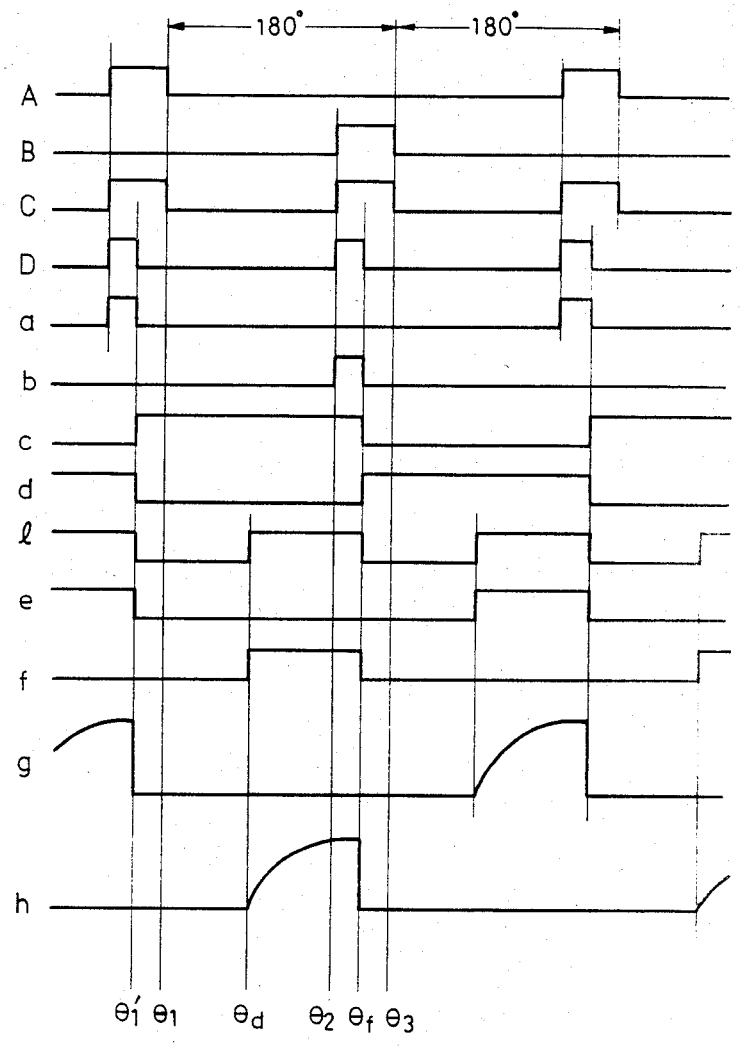
FIG. 7 is a graph showing electrical signals for producing ignition signals in accordance with the apparatus of FIG. 6.

FIG. 6 is a circuit block diagram showing a circuit configuration of a third embodiment of an ignition circuit for an internal combustion engine, and FIG. 7 is a graph showing signals for producing ignition signals in accordance with the circuit of FIG. 6. Parts and components as well as signals of this embodiment similar to those of the first embodiment shown in FIG. 2 are not shown or described herein for brevity.

In FIGS. 6 and 7, there is a modification of the connection between the input terminal of the duty cycle control circuit 5 and the output terminal of the ignition timing computing circuit 4 as well as a direct connection between the output terminal of the duty cycle control circuit and the second input terminals of the AND gates 11 and 12, without an OR gate 9 as used in the circuit of FIG. 2. In this embodiment, the duty cycle control circuit 5 receives an output signal D of the ignition timing computing circuit 4, develops an output signal of broad pulses having such a duty cycle that can directly define the duty cycle of pulse current to be fed to the ignition coils 14 and 15. Thus, the output signal l of the duty cycle control circuit 5 of this embodiment comprises pulses starting at times computed in accordance with instantaneous position of revolution of the engine obtained from the output signal D and ending at times corresponding to subsequent trailing edges of pulses of the output signal D of the ignition timing computing circuit 4.

The output signal l of the duty cycle control circuit 5 has a period defined by the period of the signal D. Thereby, the output signal l of the duty cycle control circuit 5 of this embodiment is distributed by the gates 11 and 12, applying the output signals c and d of the S-R flip-flop circuit 8 to the bases of the switching transistors 14 and 15 for producing ignition signals for the first and the second cylinders, respectively.

As in the first example of FIG. 2, in the circuit of the third embodiment of FIG. 6, the timing of ignition starting $\theta_d$ can shift just behind the limit of the timing position of $\theta_1'$ which is the timing position of the other cylinder in its most advanced state. Therefore, this embodiment also can provide sufficient ignition energy to the ignition coil even at a very high speed of rotation of the engine without insufficiency of the duty cycle of the current applied to the ignition coil.

As has been described in detail herein, this ignition circuit in accordance with the present invention can assure longer duty cycle currents to the ignition coils of an internal combustion engine even at high speeds of revolution, by such a circuit configuration utilizing a flip-flop circuit, alternately set and reset by ignition timing pulses produced by an ignition timing computing circuit, to distribute output pulses of the duty cycle control circuit to ignition devices for corresponding engine cylinders.

In this disclosure there is shown and described only the preferred embodiments of the invention, but as afore-mentioned, it is to be understood that the invention is capable of use in various other combinations and environments and is capable of changes or modifications within the scope of the inventive concept as expressed herein. For example, besides the above-mentioned use of the conventional phase detection devices 1 and 2 which produce square wave pulses as the source of the phase signal of the internal combustion engine, any other types of phase detection devices, such as electromagnetic pickup devices or optical devices, can be used as the source of the phase signal. Further, although the above-mentioned circuit embodiments are shown in the form of positive logic circuits, negative logic circuits can be easily used within the scope of the present invention by modifying to use NOR gates or NAND gates instead of the AND gates in accordance with known logic conversion practice. Also, although the above-mentioned circuit embodiments are for two cylinder internal combustion circuits, the present invention is, of course, effectively applicable to internal combustion engines of larger numbers of cylinders.

What is claimed is:

1. An ignition circuit for an internal combustion engine comprising:

igniting means;

at least two phase detection means associated respectively with at least two cylinders for producing phase signals corresponding to phase of relative motion of respective pistons within the cylinders, first gate means for producing time sequential pulse signals by combining said phase signals, ignition timing computing circuit for developing a signal defining ignition timing corresponding to engine operation parameters, a duty cycle control circuit for developing a signal for controlling duty cycle of primary current pulses for said igniting means, a flip-flop alternately set and reset in response to output signal pulses of said ignition timing computing circuit, at least two other gates responsive to the outputs of said duty cycle control circuit and said flip-flop for distributing pulses from said duty cycle control circuit to said at least two cylinders, said pulses being synchronized to said flip-flop output, and, at least two switching devices to be controlled by said igniting output pulses of said corresponding one of said at least two other gates for switching primary currents of said ignition coils.

2. An ignition circuit for an internal combustion engine in accordance with claim 1, which circuit further comprises two additional gates for distributing output signals of said ignition timing computing circuit to set and reset input terminals of said flip-flop, said output signals synchronized to timing of said phase signals.

3. An ignition circuit for an internal combustion engine in accordance with claim 1, wherein input terminal of said duty cycle control circuit is connected to the output terminal of said first gate.

4. An ignition circuit for an internal combustion engine in accordance with claim 3, further comprising at least one OR gate which produces a logical sum of said output signal of said duty cycle control circuit and said output signal of said ignition timing computing circuit, to produce said signal to be distributed by said two other gates.

5. An ignition circuit for an internal combustion engine in accordance with claim 1, wherein an input terminal of said duty cycle control circuit is connected to the output terminal of said ignition timing computing circuit.

* * * * *